US006127779A

United States Patent [19]

True

[11] Patent Number: 6,127,779

[45] Date of Patent: Oct. 3, 2000

[54] HIGH VOLTAGE STANDOFF, CURRENT REGULATING, HOLLOW ELECTRON BEAM SWITCH TUBE

[75] Inventor: Richard Brownell True, Sunnyvale, Calif.

[73] Assignee: Litton Systems, Inc., Woodland Hills, Calif.

[21] Appl. No.: 09/188,467

[22] Filed: Nov. 9, 1998

Related U.S. Application Data

[63] Continuation-in-part of application No. 08/811,394, Mar. 4, 1997, Pat. No. 5,834,898.

[51] Int. Cl.[7] ..... H01J 1/46

[52] U.S. Cl. ..... 315/5; 313/296

[58] Field of Search ..... 315/5; 313/293, 313/296, 308

[56] References Cited

U.S. PATENT DOCUMENTS

| | | | |
|---|---|---|---|
| 2,869,021 | 1/1959 | Currie | 315/3.5 |
| 2,936,393 | 5/1960 | Currie et al. | 315/3 |
| 4,293,794 | 10/1981 | Kapetanakos | 315/111.81 |
| 4,350,926 | 9/1982 | Shelton | 313/455 |
| 4,362,968 | 12/1982 | Chu et al. | 315/3.5 |
| 4,567,406 | 1/1986 | Heynisch | 315/5.33 |
| 4,745,324 | 5/1988 | True | 313/296 |
| 5,038,082 | 8/1991 | Arita et al. | 315/326 |
| 5,216,690 | 6/1993 | Hanks | 219/121.26 X |
| 5,461,282 | 10/1995 | Scheitrum et al. | 315/5.31 |
| 5,834,898 | 11/1998 | True | 315/5 |

FOREIGN PATENT DOCUMENTS

| | | |
|---|---|---|
| 0 249 324 | 12/1987 | European Pat. Off. . |
| 0 863 535 | 9/1998 | European Pat. Off. . |
| 38 27 411 | 11/1989 | Germany . |

OTHER PUBLICATIONS

"Harmonic High Power 95 GHz Peniotron" by G. Döhler et al., Proceedings Of The International Electron Devices Meeting, Washington, DC, Dec. 5–8, 1993.

"A Modular Shadow–Gridded High Power Switch Tube" by R.B. True et al., reprinted from Proceedings Of The IED-M–International Electron Devices Meeting, Washington, DC, Dec. 6–9, 1987.

*Primary Examiner*—Justin P. Bettendorf

*Attorney, Agent, or Firm*—O'Melveny & Myers LLP

[57] ABSTRACT

A high power switching apparatus comprises an annular cathode having a surface capable of emitting a hollow electron beam therefrom and an anode cavity spaced from said cathode. The cavity has an annular opening smaller in dimension than a corresponding internal dimension that defines the cavity to provide a Faraday cage collector of the hollow electron beam. A control electrode, disposed between the cathode and the anode cavity in a non-intercepting position relative to the hollow electron beam, provides a controlling electric field region for modulation of the hollow electron beam. Arc suppressing electrodes, at approximately the same potential as the cathode, are disposed between the control electrode and the anode. An intermediate high voltage electrode, disposed between the arc suppressing electrodes and the anode cavity in a non-intercepting position relative to the hollow electron beam, provides a controlling electric field region for channeling of the hollow electron beam. The intermediate high voltage electrode maintains a positive voltage with respect to the cathode in order to provide an intermediate voltage step between the cathode and the anode in the off state and to channel the hollow electron beam towards the anode in the on state. A voltage, positive with respect to the cathode, is applied to the control electrode in order to draw the hollow electron beam from the emitting surface of the cathode and into the anode. The potential of the anode is generally positive with respect to the cathode, however, it need not be at a potential as high as that of the control electrode, especially when electrons are being drawn from the cathode.

26 Claims, 10 Drawing Sheets

HIGH VOLTAGE STANDOFF, CURRENT REGULATING, HOLLOW ELECTRON BEAM SWITCH TUBE

RELATED APPLICATION

This application is a continuation-in-part of co-pending application Ser. No. 08/811,394, filed Mar. 4, 1997, now U.S. Pat. No. 5,834,898, issued on Nov. 10, 1998.

BACKGROUND OF THE INVENTION

1. Field of the Invention

The present invention relates to electron devices, and more particularly, to a switch tube adapted to rapidly change states between a high voltage non-conductive state and a high current conductive state.

2. Description of Related Art

High power switching devices are known in the art for switching between conductive and non-conductive states to provide short duration, high current pulses. A switching device must be capable of standing-off high voltages when in the non-conductive state, and rapidly switching to the high current conductive state with minimal voltage drop across the device. The high current pulses provided by a switching device have various applications in the art, such as plasma ion implantation, microwave tube current or voltage regulation, and the like.

Presently, there are two types of high power switching devices in common usage, and a third type disclosed in a previous patent by the inventor which has certain advantages over the two other types. The first type is the beam power tetrode switch tube generally comprised of a thoriated tungsten cathode wound into a cylindrical shape, a cylindrical control grid surrounding this, a screen grid, and finally a cylindrical anode outside the cylindrical screen grid. Usually, the control grid is run at an electric potential always negative with respect to cathode (if possible) to prevent interception of electrons on it and subsequent overheating. The control grid voltage is switched from a relatively high negative voltage in the beam off mode to a less negative voltage to switch the beam on. The screen grid is arranged to be in alignment with the control grid to shield it from electron interception. It is held at a potential that is positive with respect to cathode. Finally, the anode potential must be positive with respect to the cathode in order to receive electrons emitted from the cathode. There are many drawbacks to this first type of tube, including mechanical fragility of the wires comprising the cathode and grids, very high required cathode heater power, difficulty in alignment of the grid wires which can lead to grid interception and either grid emission or grid burnout, and other cathode, thermal and mechanical issues which affect reliability and which can lead to life problems when these tubes are used in high power applications.

The second type of switch tube in common use is the magnetron injection gun (MIG) type. This tube comprises a cylindrical cathode disposed concentrically within a modulating anode structure with a space defined between the cathode and the modulating anode. A Faraday cage collector is disposed axially from the cathode and modulating anode to receive the cathode current while preventing secondary electron emission. An axial magnetic field provided by an externally disposed electromagnet has flux lines that extend through the space into the opening of the collector. To switch the MIG switch tube to the conductive state, an electric potential, positive with respect to the cathode, is applied to the modulating anode causing current to be emitted from the cathode. The axial magnetic field bends the beam, preventing it from reaching the modulating anode, and directing it into the collector. While this type of switch tube has proven to be very reliable and long-lived, it has a generally higher voltage drop between the cathode and collector than other types of switch tubes making it less electrically efficient. Further, it requires an electromagnet and corresponding electromagnet power supply, which adds weight, complexity, and cost to the device.

The third type of switch tube comprises a shadow gridded tetrode device constructed from a plurality of electron guns, each having a cathode and an anode. A series of aligned grids is disposed between each cathode and anode, including a shadow grid closest to the cathode, followed thereafter by a control grid, and a screen grid. The tube also includes a suppressor grid following the screen grid having an opening generally equal to that of the edge of the cathode. In this tube, the anode includes cavities that provide a set of Faraday cage collectors to receive the cathode current. In operation, the tetrode switch tube is switched between the conductive and non-conductive states by controlling the voltage potential applied to the control grid. An example of this type of switch tube is provided by U.S. Pat. No. 4,745,324 to True, for HIGH POWER SWITCH TUBE WITH FARADAY CAGE ANODE. While the shadow gridded tetrode switch tube overcomes major limitations of both beam power tetrode and MIG switch tubes, it possesses a degree of complexity that makes it more expensive than standard beam power tetrodes, and less reliable than MIG switch tubes.

Accordingly, it would be desirable to provide a switching device having a high degree of current regulation with the ability to switch high current levels, fast switch response time, high voltage standoff capability, high switch efficiency, and very high device reliability, while overcoming these and other drawbacks of the prior art devices.

SUMMARY OF THE INVENTION

In accordance with the teachings of the present invention, a high power switching apparatus is provided. The switching apparatus can hold off high voltages with zero current flow, and rapidly switch to a high current conducting state by application of a voltage to a non-intercepting control element. The total voltage drop across the switching apparatus is kept low, which translates into high overall device efficiency.

The high power switching apparatus comprises an annular cathode having a surface capable of emitting a hollow electron beam therefrom and an anode cavity spaced from said cathode. The cavity has an annular opening smaller in dimension than a corresponding internal dimension that defines the cavity to provide a Faraday cage collector of the hollow electron beam. A control electrode is disposed between the cathode and the anode cavity in a non-intercepting position relative to the hollow electron beam. The control electrode further comprises a first electrode element disposed outside of the hollow electron beam and a second electrode element disposed inside of the hollow electron beam. A controlling electric field region is provided between the first and second control electrode elements for modulation of the hollow electron beam. An arc suppressing electrode is disposed between the control electrode and the anode. The arc suppressing electrode further comprises a first arc suppressing electrode disposed outside of the hollow beam and a second arc suppressing electrode disposed inside of the hollow beam. The arc suppressing electrodes are at approximately the same electric potential as the cathode.

In an embodiment of the high power current regulating switch tube, an intermediate high voltage electrode is disposed between the arc suppressing electrode and the anode in order to divide the high voltage gap between the cathode and anode into two or more lower voltage regions. The intermediate high voltage electrode further comprises a first intermediate high voltage electrode disposed outside of the hollow beam and a second intermediate high voltage electrode disposed inside of the hollow beam. The first and second intermediate high voltage electrodes are at a positive voltage with respect to the cathode. A voltage, positive with respect to cathode, is applied to the control electrodes in order to draw the hollow electron beam from the emitting surface of the cathode. The potential of the anode cavity is generally positive with respect to the cathode in order for emitted electrons to reach it, however, it need not be at a potential as high as that of the control electrodes.

A more complete understanding of the high power current regulating switch tube will be afforded to those skilled in the art, as well as a realization of additional advantages and objects thereof, by a consideration of the following detailed description of the preferred embodiments. Reference will be made to the appended sheets of drawings which will first be described briefly.

DETAILED DESCRIPTION OF THE PREFERRED EMBODIMENTS

The present invention satisfies the need for a switching device having a high degree of current regulation with the ability to switch high current levels, fast switch response time, high voltage standoff capability, high switch efficiency, and very high device reliability. In the detailed description that follows, like element numerals are used to describe like elements illustrated in one or more of the figures for the first and second embodiments of the present invention.

Figure 1:
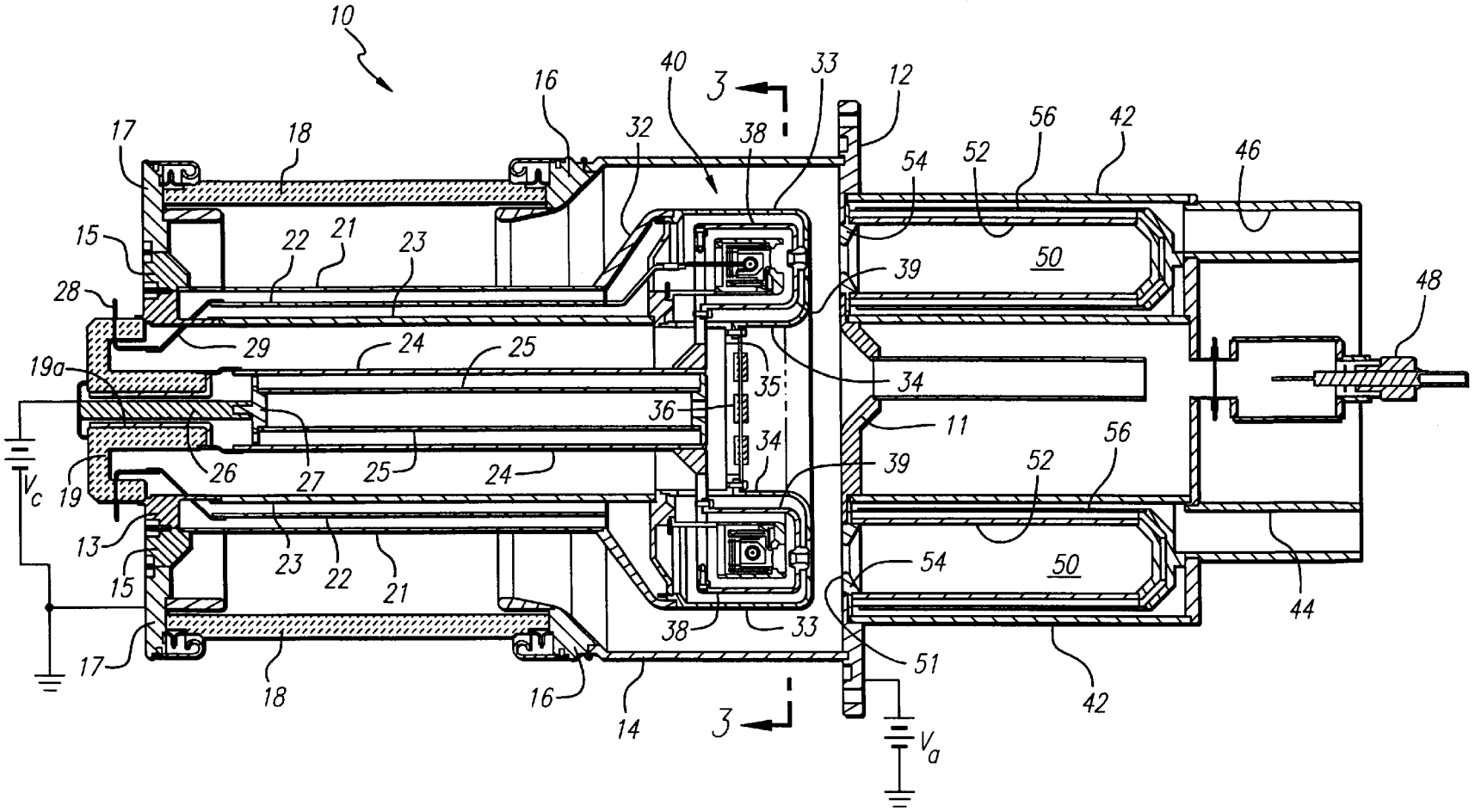
FIG. 1 is a side sectional view of a high power switch tube in accordance with a first embodiment of the present invention.

Referring first to FIG. 1, a high power switch tube 10 in accordance with a first embodiment of the present invention is illustrated. The switch tube 10 has two main portions defined relative to a centrally disposed mounting plate 12, including an electron emitting portion disposed to the left of the mounting plate as illustrated in FIG. 1, and an electron collecting portion disposed to the right of the mounting plate. It should be appreciated that the switch tube 10 would ordinarily be operated in a vertical configuration (rather than the horizontal configuration illustrated in FIG. 1), with the electron gun portion directed downward and the collector portion directed upward. The electron gun portion may be immersed in a fluid reservoir, such as a tank of oil, in order to prevent external high voltage arcing and disperse some of the heat generated during operation of the switch tube 10. When disposed in the vertical (i.e., operational) position, the mounting plate 12 provides a surface for fixedly mounting the switch tube to the reservoir or other structural element.

The electron emitting portion of the switch tube 10 is provided with a rugged outer structure which is generally symmetrical around a central axis of the switch tube. The outer structure includes a first cylindrical housing segment 14 that engages a circular groove provided in a surface of the mounting plate 12. A transition adapter 16 is coupled to an end of the first housing segment 14 opposite from the mounting plate 12. A second cylindrical housing segment 18 extends from the transition adapter 16. The second housing segment 18 has an inside diameter slightly smaller than the inside diameter of the first housing segment 14, and the transition adapter 16 serves to transition between the two distinct housing segments. An outer end ring 17 mates with the second housing segment 18 to partially enclose an end of the switch tube 10 in conjunction with an intermediate end ring 15 and an inner end ring 13. The mounting plate 12, first housing segment 14, transition adapter 16, outer end ring 17, and intermediate end ring 15 may be comprised of a high strength, electrically conductive, non-corrosive material, such as stainless steel. The second housing segment 18 may be comprised of a thermally conductive, electrically insulating material, such as aluminum oxide (alumina) ceramic.

The electron emitting portion of the switch tube 10 further includes a plurality of distinct electrodes that are electrically connected at the bottom end of the device (illustrated at the left side of FIG. 1). The electrical connections are provided as a series of concentric cylinders, including an outer arc suppression cylinder 21, a cathode heater cylinder 22, a cathode support and inner arc suppression cylinder 23, a control electrode support cylinder 24 and a control electrode cylinder 25. The control electrode support cylinder 24 and the control electrode cylinder 25 are terminated by an end cap 27 that is further joined to a control electrode terminal 26. An insulated plug 19 surrounds concentrically the electrode terminal 26, and is mechanically coupled to the control electrode support cylinder 24 for structural rigidity.

The intermediate end ring 15 is coupled to the outer end ring 17 which, in turn, is coupled to the inner end ring 13 which is coupled to the insulated plug 19. The cathode support and inner arc suppression cylinder 23 is coupled to the inner end ring 13. The cathode heater cylinder 22 is coupled to an electrical lead structure 29 that extends through an innermost portion of the inner end ring 13 and through the insulated plug 19 to provide a cathode heater terminal 28. The outer end ring 17, intermediate end ring 15, inner end ring 13, and insulated plug 19 collectively define the end of the switch tube 10. The electron emitting portion may further include one or more absorber buttons 36 affixed to a centrally disposed plate 35 coupled to the inner arc suppression cylinder 23. The absorber buttons 36 absorb undesired RF power within the switch tube 10, as known in the art. The absorber buttons may be comprised of silicon carbide-loaded beryllium oxide ceramic or other lossy material compatible with use in a vacuum.

In order to keep the control electrodes cool, the control electrode cylinder 25 must have high thermal conductivity and thus may be comprised of a highly conductive material, such as copper. Similarly, the control electrode terminal 26 and the cathode support and inner arc suppression cylinder 23 may be comprised of a refractory conductive material, such as molybdenum. The insulated plug 19 may be comprised of a thermally conductive, electrically insulating material, such as alumina ceramic. The inner surface of the insulated plug 19 facing the electrode terminal may be provided with a resistive metal layer 19*a*, such as molybdenum-manganese metallization or aquadag (carbon). The outer arc suppression cylinder 21 and the control electrode support cylinder 24 may be comprised of a high strength, electrically conductive, non-corrosive material, such as stainless steel. The cathode heater cylinder 22 may be comprised of an electrically conductive material, such as monel or kovar.

The electron collecting portion of the switch tube 10, in accordance with a first embodiment of the present invention, includes a third cylindrical housing segment 42 that engages a circular groove provided in the surface of the mounting plate 12 opposite from the first housing segment 14. An annular-shaped double-walled Faraday cage collector 50 is coupled to the mounting plate 12 within the third housing segment 42, defining an annular-shaped electron receiving opening 51 formed by shoulders 54 disposed in the same plane as the mounting plate. As will be further described below, the electron receiving opening 51 provides an anode of the electron gun 40. A center plate 11 is coupled to the inner edge of the electron receiving opening, which is also disposed in the same plane as the mounting plate 12. The collector 50 includes an inner wall 52 that defines an inner dimension which is greater than the electron receiving opening, and an outer wall 56 having an inner dimension slightly larger than the inner wall 52 such that a coolant space is defined therebetween. As will be further described below, the electron receiving opening is disposed in substantial alignment with the electron gun 40 of the electron emitting portion described above. The inner wall 52, outer wall 56 and shoulders 54 may be comprised of a highly conductive material, such as copper.

The third housing segment 42 further includes a coolant flow inlet pipe 44 and a coolant flow outlet pipe 46. The coolant flow inlet and outlet pipes 44, 46 permit the attachment of the switch tube 10 to a coolant system which includes a coolant fluid reservoir (not shown). The coolant system provides a source of coolant fluid, such as water or alcohol, to the coolant flow inlet and outlet pipes 44, 46. A coolant flow path is defined through the electron collecting portion of the switch tube 10 between the coolant flow inlet and outlet pipes 44, 46, which includes the space defined between the inner and outer walls 52, 56 of the collector 50. The coolant flow path may further include heat radiating members, such as fins, to improve the heat conductance from the electron collecting portion to the coolant system. In addition, an ion pump 48 is provided at an end of the electron collecting portion adjacent to the coolant flown inlet and outlet pipes 44, 46. The ion pump 48 provides a vacuum within the switch tube 10, as known in the art. The third housing segment 42, the coolant flown inlet and outlet pipes 44, 46, and the center plate 11 may be comprised of a high strength, electrically conductive, non-corrosive material, such as stainless steel.

Figure 2:
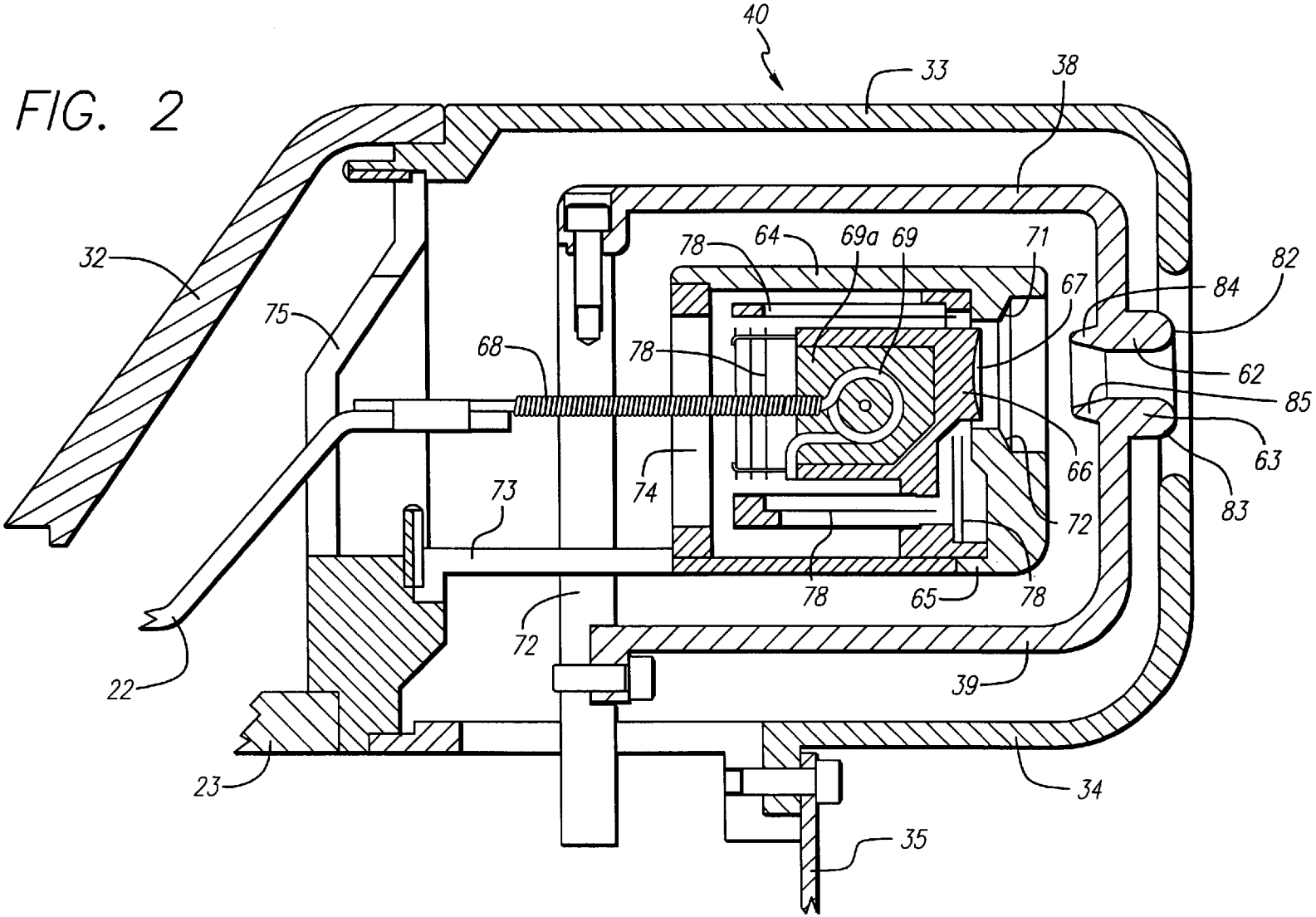
FIG. 2 is an enlarged side sectional view of the cathode of the high power switch tube.

Referring now to FIG. 2, the electron gun 40 of the switch tube 10 is illustrated in greater detail. The electron gun 40 includes a cathode 66 having an electron emitting surface 67. A heater coil 69 is embedded within the cathode 66 and is electrically coupled via an electrical lead 68 to the cathode heater cylinder 22. The heater coil 69 is used to raise the temperature of the cathode 66 sufficiently to permit thermionic emissions of electrons from the electron emitting surface 67, as is known in the art. It should be appreciated that the cathode 66 and the electron emitting surface 67 have an annular shape due to the axial symmetry of the switch tube 10, as described above with respect to FIG. 1. The electron emitting surface 67 is slightly concave, which helps to prevent emitted electrons from striking the control electrode ends 62, 63 during operation of the switch tube 10, which will be discussed below.

The cathode 66 may be a tungsten matrix dispenser cathode as is known in the art. The surface 67 of cathode 66 may be coated with various elements or compounds such as osmium and ruthenium (providing a so-called M-type cathode) in order to lower the required cathode temperature for a given level of electron emission as is known in the art. Further, the heater coil 69 may be made from tungsten, molybdenum, or other refractory material, or combinations thereof, as is known in the art. The heater overwrap 68 may be a conductive refractory metal such as molybdenum. The heater coil 69 may be affixed within the cathode 66 by potting in alumina ceramic 69*a* as is known in the art.

The cathode 66 is mechanically supported within a conductive shell defined by an outer support member 64 and an inner support member 65. One or more heat shields 78 may be provided between the cathode 66 and the outer and inner support members 64, 65, to control heat radiation from the cathode. The outer and inner support members 64, 65 are generally cylindrical in shape, and are mechanically and electrically coupled together through a cross member 74, and to the outer and inner arc suppression cylinders 21, 23 through a cross member 73. The forward portions of the outer and inner support members 64, 65 adjacent to the electron emitting surface 67 include shoulders 71, 72, respectively. The shoulders 71, 72 provide a focusing electrode for the cathode 66 to define the shape of the electric field region formed between the cathode and the control electrode ends 62, 63. The outer and inner support members 64, 65 may be comprised of an electrically conductive refractory material, such as molybdenum.

Outer and inner control electrodes 38, 39 are spaced outwardly from the cathode 66 and outer and inner support members 64, 65, and are used to control electron flow from the cathode, as will be further described below. The outer and inner control electrodes 38, 39 are mechanically and electrically coupled together through a cross member 77 and to the control electrode cylinder 24. The outer and inner control electrodes 38, 39 are electrically isolated from the cathode 66. The forward portions of the outer and inner control electrodes 38, 39 adjacent to the electron emitting surface 67 and the shoulders 71, 72 have respective electrode ends 62, 63 with an opening defined therebetween. The electrode ends 62, 63 each have a hammerhead shape with rounded outer portions 82, 83, and tapered inner portions 84, 85, respectively. Between the outer portions 82, 83 and the inner portions 84, 85, the electrode ends 62, 63 have substantially parallel surfaces that contribute to the formation of a positive electric field region to choke off electron flow from the electron emitting surface 67, as will be described below.

Outer and inner arc suppression electrodes 33, 34 are spaced outwardly from the outer and inner control electrodes 38, 39 and are used to prevent arc current from flowing through the control electrode modulator power supply ($V_C$) and to reduce the Miller effect capacitance for faster switching speed. The outer and inner arc suppression electrodes 33, 34 are mechanically and electrically coupled together through a cross member 75. The outer arc suppression electrode 33 is further coupled through a flared coupler 32 to the outer arc suppression cylinder 21, and the inner arc suppression electrode 34 is further coupled to the inner cathode support and arc suppression cylinder 23. The outer and inner arc suppression electrodes 33, 34 are electrically isolated from the outer and inner control electrodes 38, 39, and are electrically coupled to the cathode 66 and to the outer and inner support members 64, 65.

Figure 3:
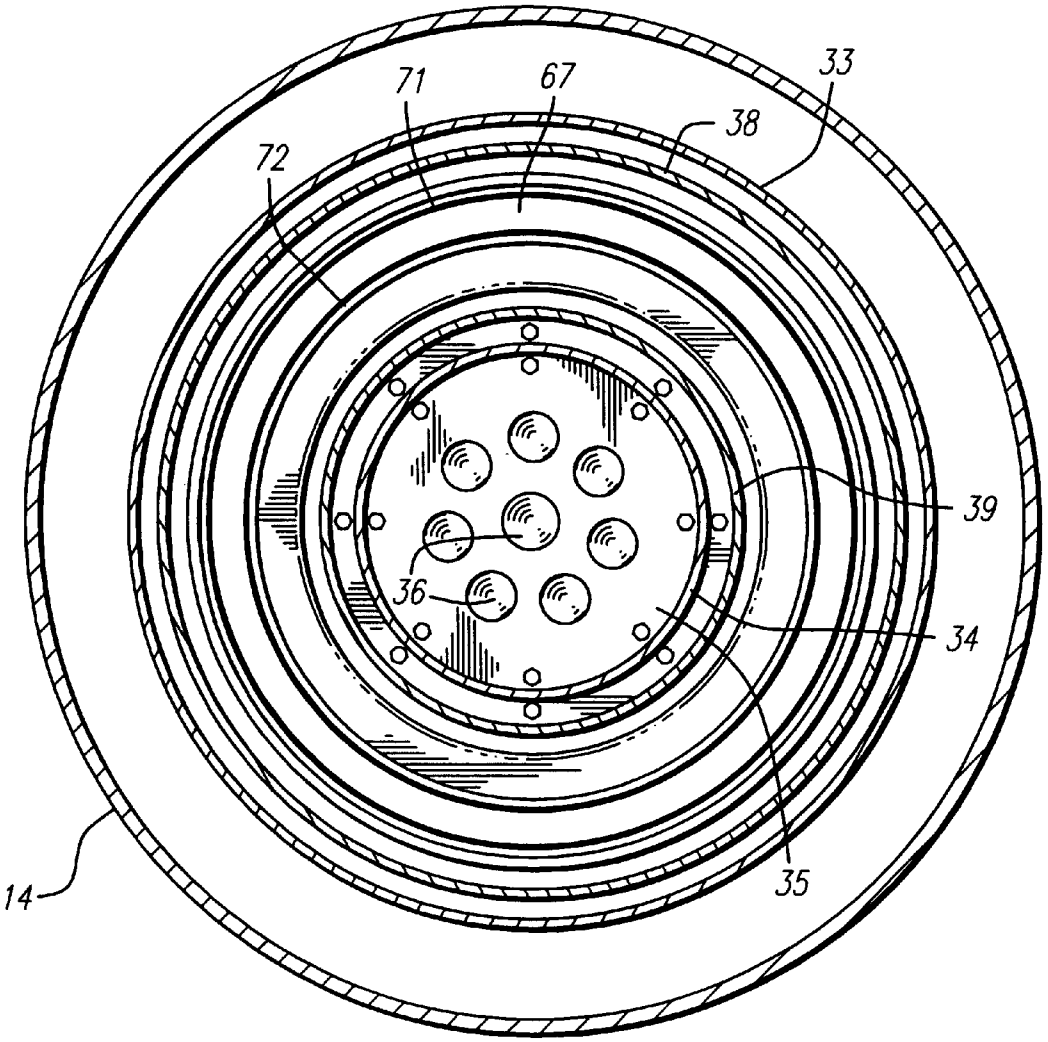
FIG. 3 is an end sectional view of the high power switch tube taken through the section 3—3 of FIG. 1.

FIG. 3 illustrates the symmetrical nature of the switch tube 10 in which the various electrodes appear as concentric cylinders. Particularly, from the exterior of the switch tube 10 inward, the concentric cylinders include the first housing segment 14, the outer arc suppression electrode 33, the outer control electrode 38, the inner control electrode 39, and the inner arc suppression electrode 34. The electron emitting surface 67 is also illustrated between the shoulders 71, 72. As best illustrated in FIG. 1, the electron emitting surface 67 is aligned with the space defined between the control electrode ends 62, 63, and the annular opening to the collector 50.

Figure 4A:
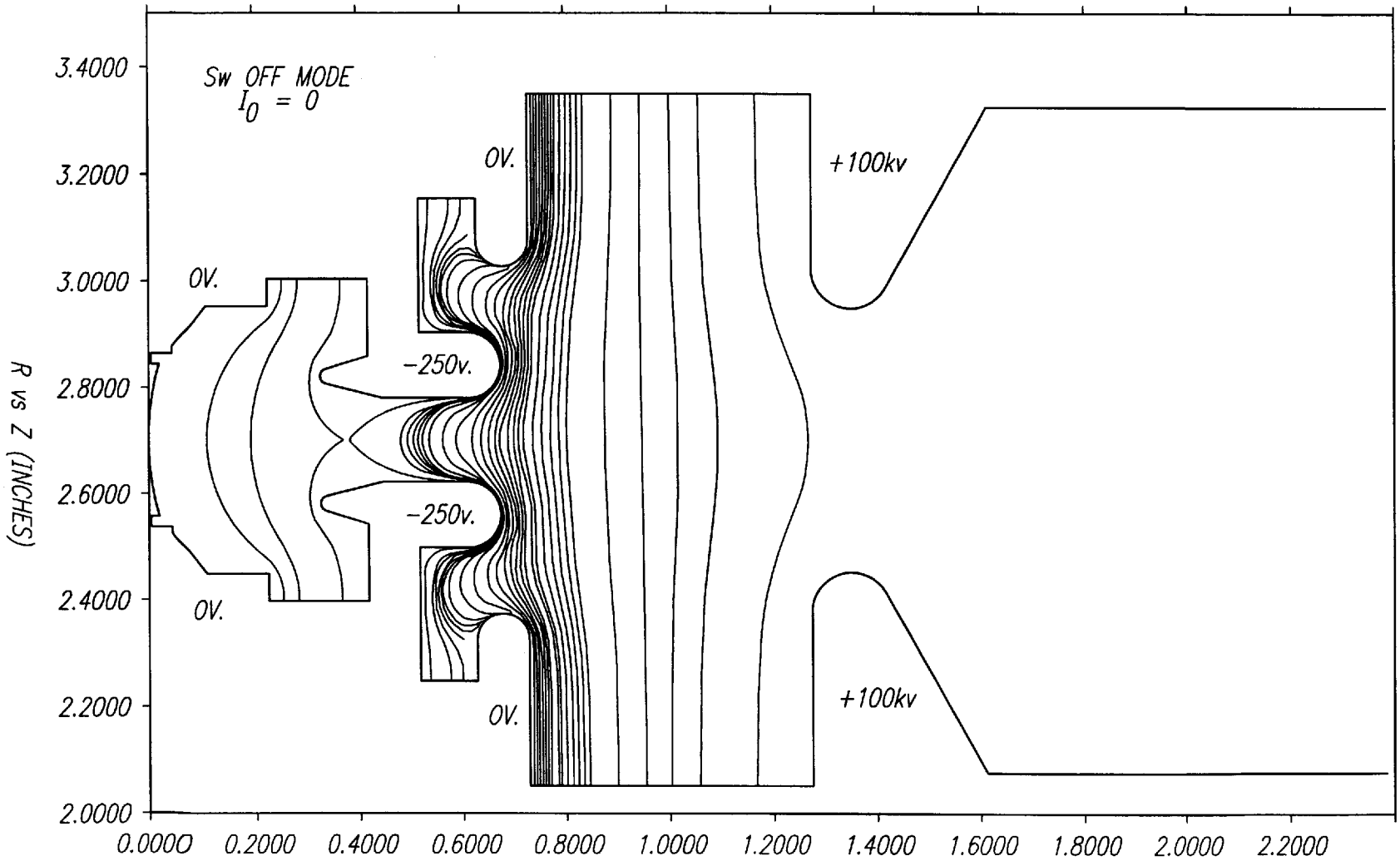
FIGS. 4A and 4B are computer simulations of the high power switch tube in accordance with a first embodiment of the present invention in non-conducting and conducting states, respectively.

The operation of the switch tube 10, in accordance with a first embodiment of the present invention, in its non-conductive and conductive states will be described with reference to FIGS. 4A and 4B, wherein the electron trajectories are shown as generally horizontal lines and the equipotential contours are shown as generally vertical lines in a computer plot. Referring first to FIG. 4A, the switch tube 10 is shown in a non-conductive state with the cathode 66 and the arc suppression electrodes 33, 34 connected to ground potential, or an electric potential of zero volts. The control electrodes 38, 39 are depressed to a potential below that of the cathode 55, such as −250 volts, by the control electrode modulator power supply ($V_C$). The anode 51 is connected to a voltage source ($V_A$) to apply a positive electric potential of greater than +100 kilovolts. In this condition, there is no current ($I_0$) flowing through the switch tube 10.

Figure 4B:
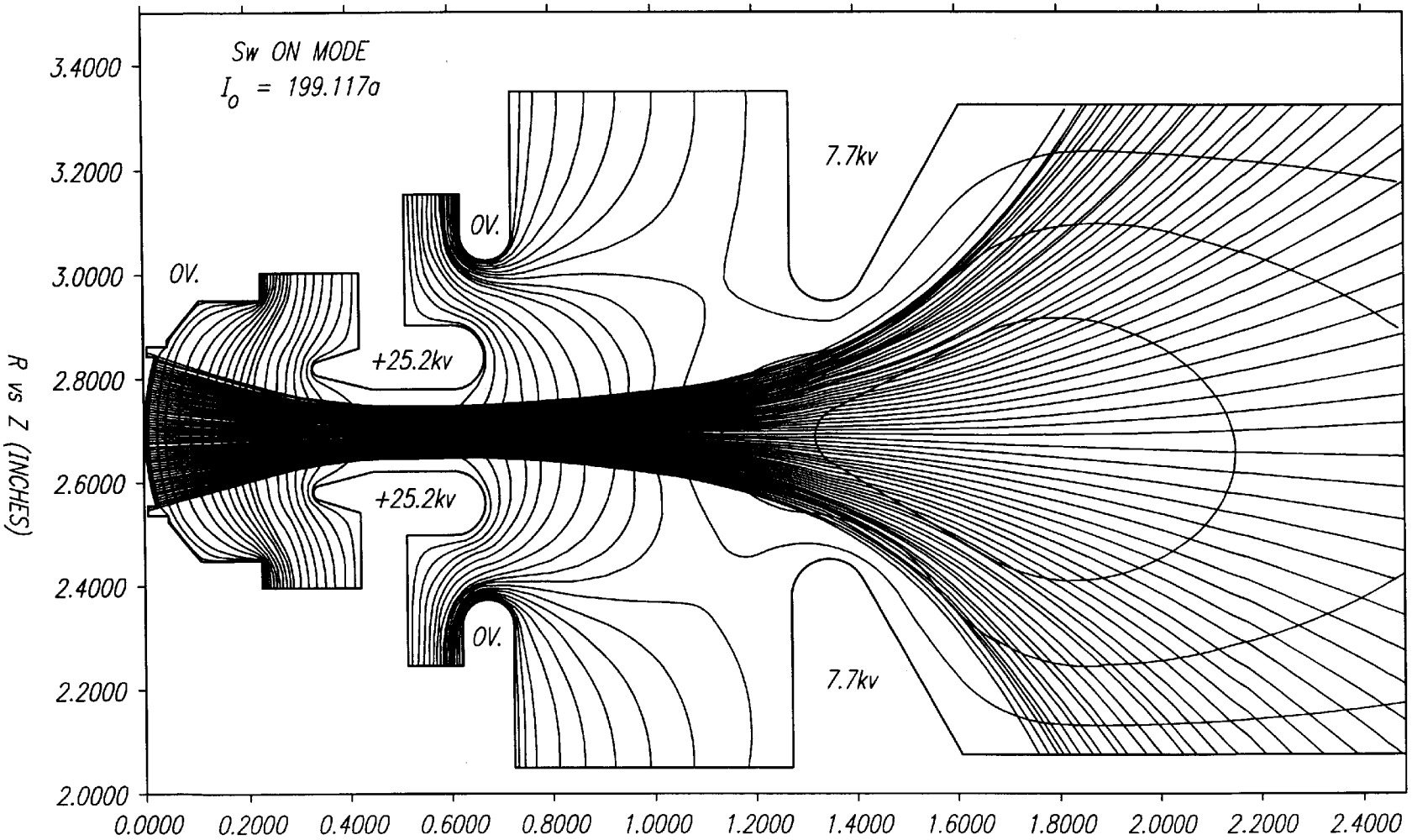

In FIG. 4B, the switch tube 10 is shown in a conductive state. As in the non-conductive state, the cathode 66 and the arc suppression electrodes 33, 34 are connected to ground potential, or zero volts. A voltage, positive with respect to the cathode 66, is applied to the control electrodes 38, 39 in order to draw the hollow electron beam from the emitting surface of the cathode to the anode 51. The potential of the anode 51 is generally positive with respect to the cathode 66, however, it need not be at a potential as high as that of the control electrodes 38, 39 especially when electrons are being drawn from the cathode.

In the first embodiment, the potential on the control electrodes 38, 39 is increased from −250 volts to +25.2 kilovolts by the control electrode modulator power supply ($V_C$). The potential on the anode 51 drops to an electric potential of +7.7 kilovolts. With the switch tube 10 in the conductive state, a current carrying capacity of approximately 200 amps may be achieved. Thus, it can be seen in the first embodiment of the invention that the control electrodes 38, 39 functions to turn on or off the beam current with a voltage change of roughly 25 kilovolts. While all the voltages have been expressed with respect to the cathode 66 which is at ground potential, it should be understood that the switch tube 10 could also be operated with the anode at ground potential and the cathode at a negative voltage.

The electrons of the beam pass the anode 51 into the collector 50, and are spread over the internal surface area of the collector. By spreading the electrons in this manner, there is more even heat transfer to the coolant flow which lowers the internal surface temperature of the collector, which, in turn, extends the life of the switch tube 10. The Faraday cage collector 50 also acts to prevent secondary emission of electrons from the collector. Moreover, the positive voltage on the control electrodes 38, 39 with respect to the cathode 66 forms an ion trap which prevents ions that may be created in the collector 50 from returning to the cathode. Ionic back-bombardment of the cathode is known to lead to reduced cathode life, and therefore its prevention is a desirable feature of the invention.

Figure 5:
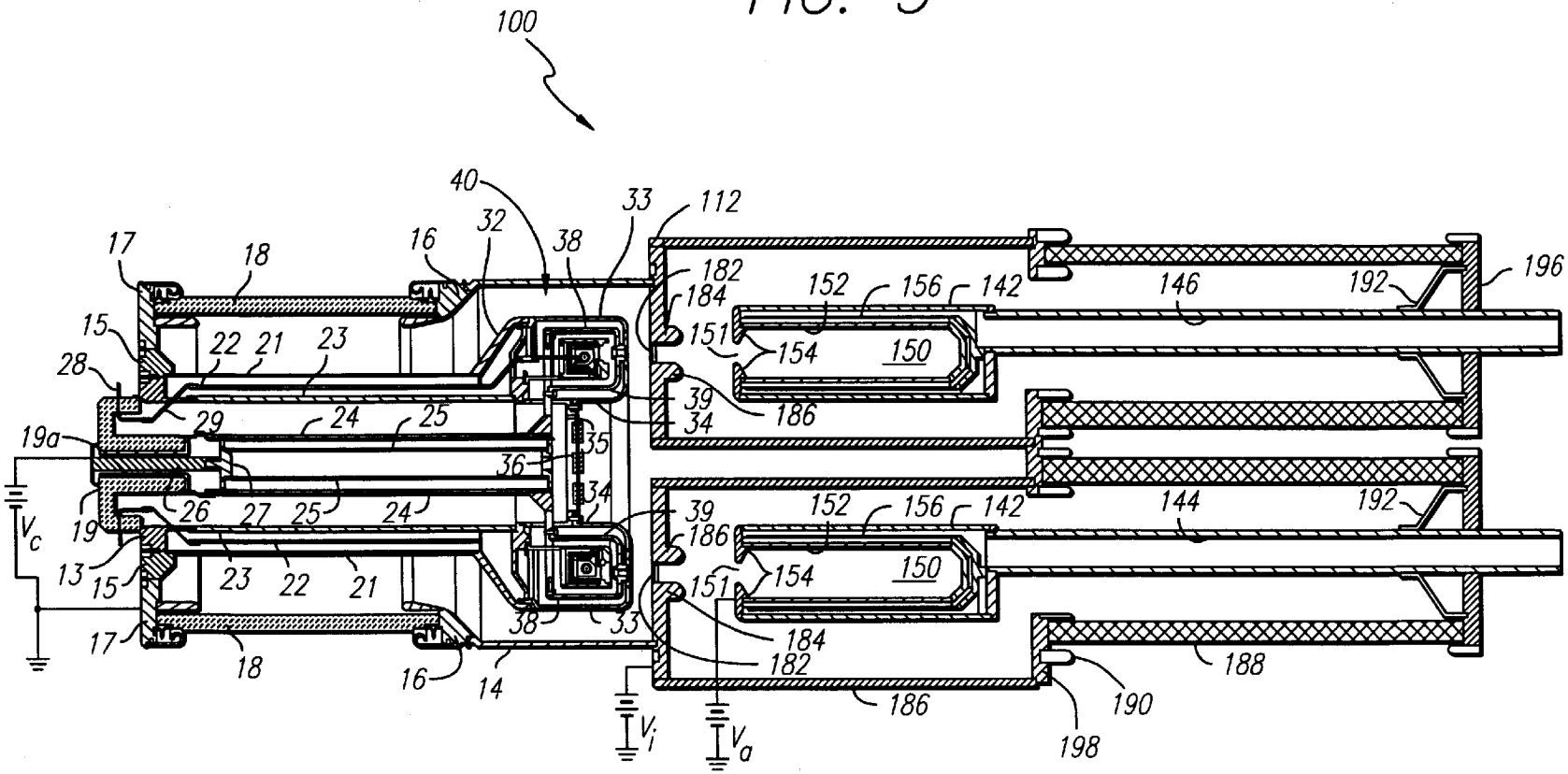
FIG. 5 is a side sectional view of a high power switch tube in accordance with a second embodiment of the present invention.

Referring to FIG. 5, a high power switch tube 100 in accordance with a second embodiment of the present invention is illustrated. The switch tube 100, as with the first embodiment discussed above, has two main portions defined relative to a centrally disposed mounting plate 112, including an electron emitting portion disposed to the left of the mounting plate 112 as illustrated in FIG. 5, and an electron collecting portion disposed to the right of the mounting plate 112. It should be appreciated that the switch tube 100 would ordinarily be operated in a vertical configuration (rather than the horizontal configuration illustrated in FIG. 5), with the electron emitting portion directed downward and the electron collecting portion directed upward. The entire switch tube 100 may be immersed in a fluid reservoir, such as a tank of oil, in order to prevent external high voltage arcing and disperse some of the heat generated during operation of the switch tube 100.

The electron emitting portion of the switch tube 100 in accordance with the second embodiment is similar to the electron emitting portion of the switch tube 10 in accordance with the first embodiment, with like element numerals used to describe like elements illustrated. Therefore, a general description of the electron emitting portion of the switch tube 100 is not repeated.

The electron collecting portion of the switch tube 100, shown in FIG. 5, includes a third cylindrical housing segment 186 that engages the surface of the mounting plate 112 opposite from the first housing segment 14. The third cylindrical housing segment 186 is partially enclosed by a transition plate 198 which is opposite the mounting plate 112. Cylindrical support posts 188 attach to the transition plate 198 using transition ring adapters 190 which define openings in the transition plate 198. These openings allow the cylindrical support posts 188 to suspend an annular-shaped double-walled Faraday cage collector 150 within the third cylindrical housing segment 186. The cylindrical support posts 188 are enclosed by attaching an end cap 196. Using cylindrical support posts 188 and the end cap 196, the switch tube 100 can be mounted on ceramic insulators (not shown) to provide further electrical isolation. The mounting plate 112, third cylindrical housing segment 186, transition plate 198, and transition ring adapters 190 may be comprised of a high strength, electrically conductive, non-corrosive material, such as stainless steel. The cylindrical support posts 188 and end cap 196 may be comprised of a thermally conductive, electrically insulating material, such as aluminum oxide (alumina).

The Faraday cage collector 150 defines an annular-shaped electron receiving opening 151 formed by shoulders 154 disposed in the same plane as the mounting plate 112. The electron receiving opening 151 aligns with an annular-shaped electron receiving opening 182 in mounting plate 112 defined by outer and inner intermediate high voltage electrodes 184, 186. As will be further described below, the electron receiving opening 151 provides an anode of the electron gun 40, electron receiving opening 182 provides a channel for the hollow electron beam, and outer and inner intermediate high voltage electrodes 184, 186 provide an intermediate high voltage step to split the high voltage gap between the cathode and the anode into two lower voltage regions for reliable high voltage standoff.

The collector 150 includes an inner wall 152 that defines an inner dimension which is greater than the electron receiving opening, and an outer wall 156 having an inner dimension slightly larger than the inner wall 152 such that a coolant space is defined therebetween. As will be further described below, the electron receiving openings 151 and 182 are disposed in substantial alignment with the electron gun 40 of the electron emitting portion described above.

The cylindrical support posts 188 and the end cap 196 further provide for a coolant flow inlet pipe 144 and a coolant flow outlet pipe 146 with structural support for coolant flow inlet and outlet pipes 144, 146 provided by support brackets 192. The coolant flow inlet and outlet pipes 144, 146 permit the attachment of the switch tube 100 to a coolant system which includes a coolant fluid reservoir (not shown). The coolant system provides a source of coolant fluid, such as water or alcohol, to the coolant flow inlet and outlet pipes 144, 146. A coolant flow path is defined through the electron collecting portion of the switch tube 100 between the coolant flow inlet and outlet pipes 144, 146, which includes the space defined between the inner and outer walls 152, 156 of the collector 150. The coolant flow path may further include heat radiating members, such as fins, to improve the heat conductance from the electron collecting portion to the coolant system. In addition, end cap 196 further provides for the location of an ion pump adjacent to the coolant flown inlet and outlet pipes 144, 146. The ion pump provides a vacuum within the switch tube 100, as known in the art. The coolant flow inlet and outlet pipes 144, 146, may be comprised of a high strength, electrically conductive, non-corrosive material, such as stainless steel.

Figure 6:
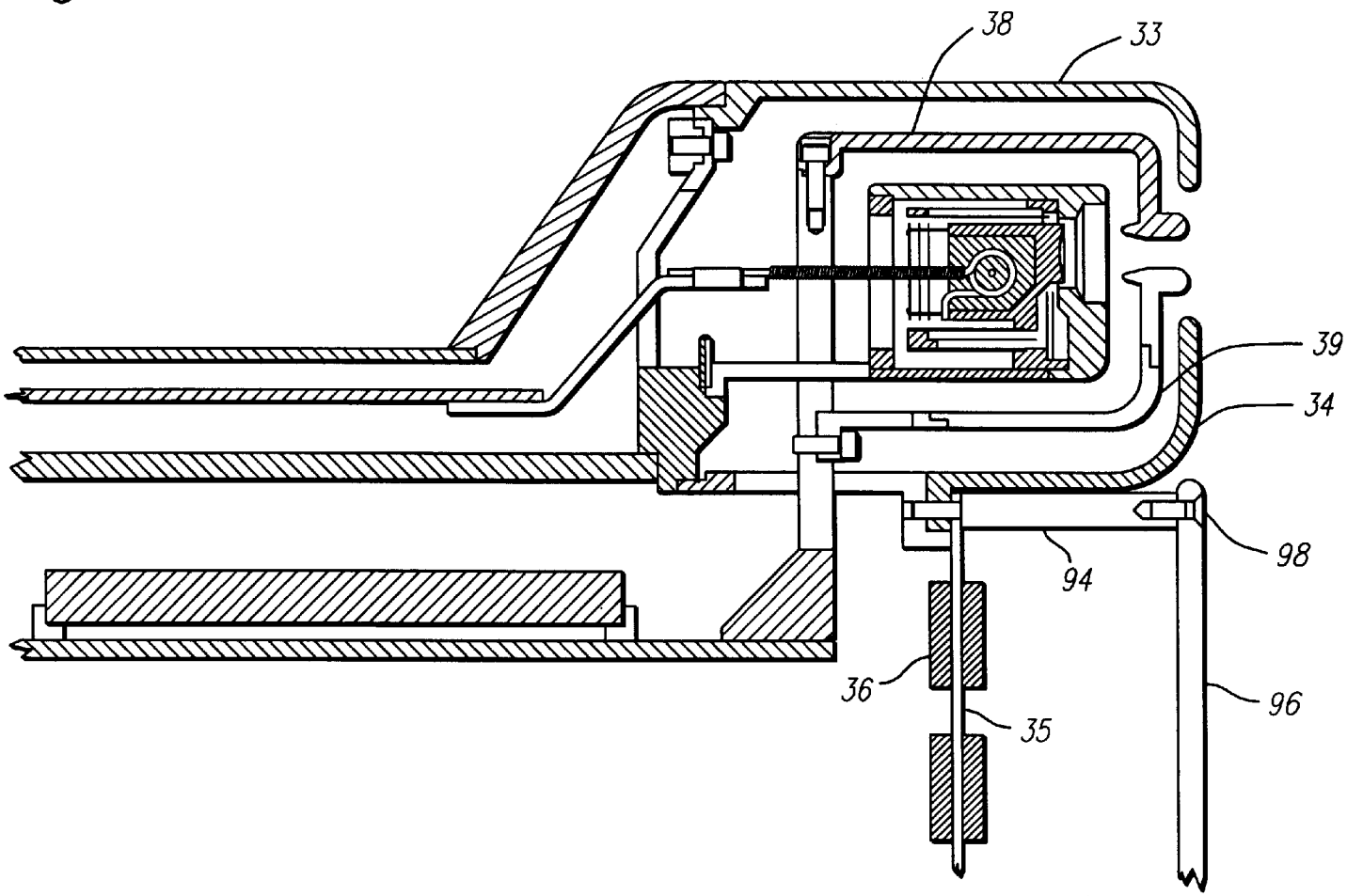
FIG. 6 is an enlarged side sectional view of the cathode of a high power switch tube in accordance with a third embodiment of the present invention.

FIG. 6 provides an electron emitting portion of the switch tube 100 in accordance with a third embodiment of the present invention. FIG. 6 shows an enlarged side sectional view of the electron gun 40 of the switch tube 100. A cover plate 96 is shown disposed centrally in the area defined by the inner arc suppression electrode 34. The cover plate 96 is supported by a plurality of support posts 94. One end of the support posts 94 is attached to the cover plate 96 with a plurality of screws 98 and the other end is affixed to the centrally disposed plate 35.

The cover plate 96 reduces the size of potential resonant cavities and suppresses spurious RF oscillation modes within the center portion of the electron emitting portion of switch tube 100 defined by the inner arc suppression electrode 34. The cover plate 96 also shields the absorber buttons 36 from high electrostatic fields that develop between the outer and inner arc suppression electrodes 33, 34 and the electron collecting portion of the switch tube 100. Finally, the cover plate 96 forces undesired RF current to flow, in the gap between the cover plate 96 and the inner arc suppression electrode 34, to the absorber buttons 36 for absorption. The cover plate 96 may be comprised of stainless steel.

Figure 7A:
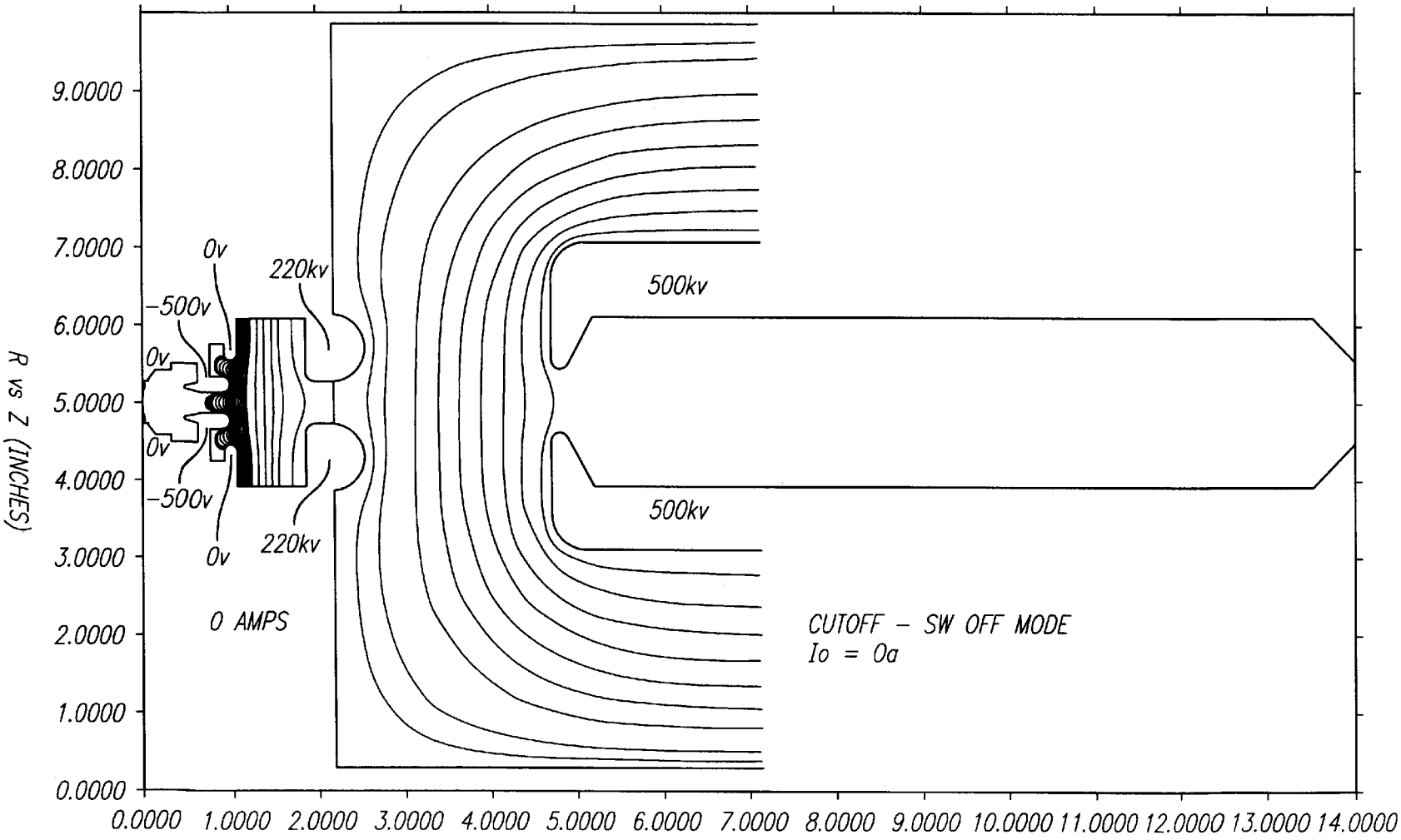
FIGS. 7A and 7B are computer simulations of the high power switch tube in accordance with a second embodiment of the present invention in non-conducting and conducting states, respectively.

The operation of the switch tube 100, in accordance with a second embodiment of the present invention, in its non-conductive and conductive states will be described with reference to FIGS. 7A and 7B, wherein the electron trajectories are shown as generally horizontal lines and the equipotential contours are shown as generally vertical lines in a computer plot. Referring first to FIG. 7A, the switch tube 100 is shown in a non-conductive state with the cathode 66 and the arc suppression electrodes 33, 34 connected to ground potential, or an electric potential of zero volts. The control electrodes 38, 39 are depressed to a potential below that of the cathode 66, such as −500 volts, by the control electrode modulator power supply ($V_C$). The intermediate high voltage electrodes 184, 186 are connected to an intermediate voltage source ($V_i$) to apply a positive electric potential of approximately +220 kilovolts and shoulders 154 which forms anode 151 is connected to voltage source ($V_A$) to apply a final positive electric potential of approximately +500 kilovolts. The electron receiving opening 182, formed by intermediate high voltage electrodes 184, 186, provides an intermediate high voltage step to split the high voltage gap from cathode to anode into two lower voltage regions. In this condition, there is no current ($I_0$) flowing through the switch tube 100.

Figure 7B:
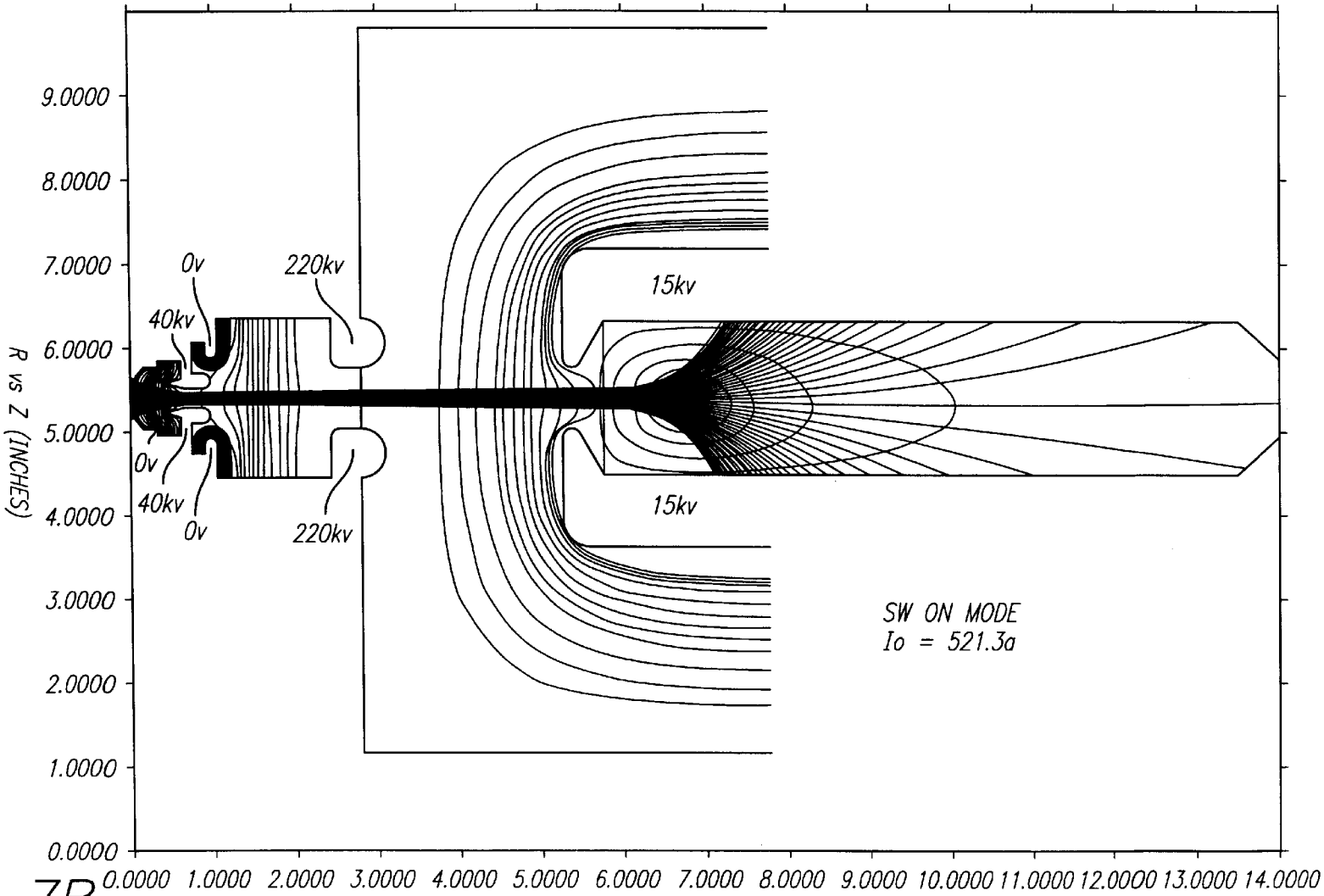

In FIG. 7B, the switch tube 100 is shown in a conductive state. As in the non-conductive state, the cathode 66 and the arc suppression electrodes 33, 34 are connected to ground potential, or zero volts. A voltage, positive with respect to the cathode 66, is applied to the control electrodes 38, 39 in order to draw the hollow electron beam from the emitting surface of the cathode, through the electron receiving opening 182, to the anode 151. The potential of the anode 151 is generally positive with respect to the cathode 66, however, it need not be at a potential as high as that of the control electrodes 38, 39 especially when electrons are being drawn from the cathode. The electron receiving opening 182, formed by intermediate high voltage electrodes 184, 186, channels the hollow electron beam and accelerates the electrons towards anode 151.

More specifically as an example for the second embodiment, the potential on the control electrodes 38, 39 may be increased from −500 volts to +40 kilovolts by the control electrode modulator power supply ($V_C$). The potential on the anode 151 drops to an electric potential of +15 kilovolts while intermediate high voltage electrodes 184, 186 remain at +220 kilovolts in order to channel and accelerate the electrons towards anode 151. With the switch tube 100 in the conductive state, a current carrying capacity of approximately 521 amps may be achieved. Thus, it can be seen in the second embodiment of the invention that the control electrodes 38, 39 functions to turn on or off the beam current with a voltage change of roughly 40 kilovolts. While all the voltages have been expressed with respect to the cathode 66 which is at ground potential, it should be understood that the switch tube 100 could also be operated with the anode at ground potential and the cathode at a negative voltage.

The electrons of the beam pass the anode 151 into the collector 150, and are spread over the internal surface area of the collector in a similar fashion as described above for the first embodiment. For the second embodiment, the presence of electron receiving opening 182 formed by intermediate high voltage electrodes 184, 186 provides a channel for the hollow electron beam when the switch tube 100 is allowing current flow (on state) and also provides at least one intermediate high voltage step to split the high voltage gap between cathode and anode into two lower voltage regions when the switch tube 100 is preventing current flow (off state). This provides reliable high voltage standoff and protects against switch tube arcing which can damage sensitive devices such as klystrons that are electrically connected to the switch tube 100.

Figure 8:
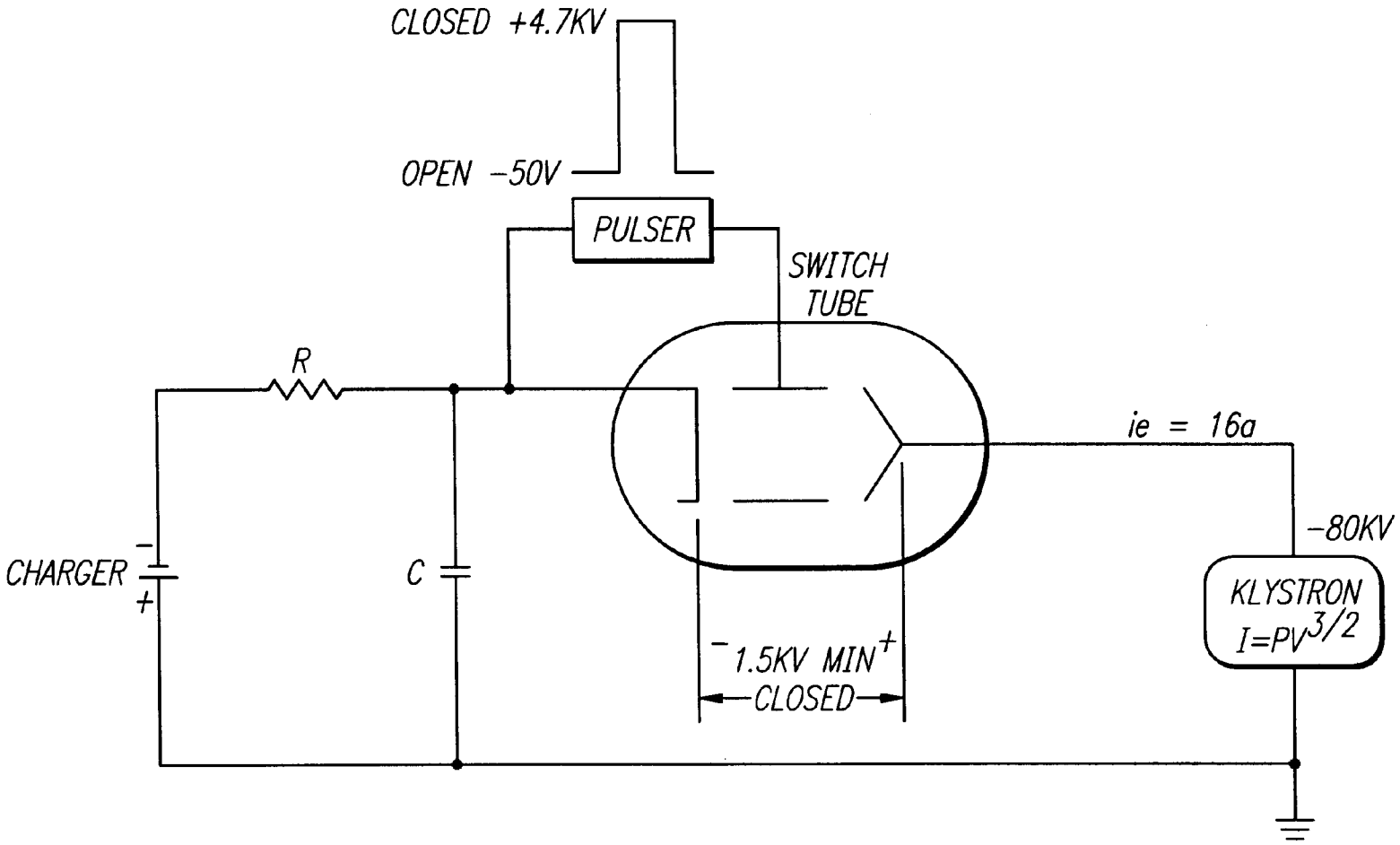
FIG. 8 is a simple schematic diagram showing one possible use for an embodiment of the present invention.

FIG. 8 illustrates by way of a simple schematic diagram a possible use of an embodiment of the present invention. The charger builds up the energy stored in the capacitor (C) through current limiting resistor (R) during the time period that the switch tube, controlled by the pulser, is turned off. When the pulser turns on the switch tube, the switch tube allows the capacitor to discharge a portion of its stored energy to the klystron. The pulser then turns off the switch tube and the cycle repeats.

In a diode space-charge limited klystron electron gun, perveance represents a constant of proportionality between current, I, and applied voltage, V, raised to the 3/2 power (this relationship is commonly known as the "three-halves power law"). If the switch tube provides essentially constant current to the klystron during the pulse, and the perveance of the klystron is constant, it can be appreciated that a substantially constant voltage will be delivered to the klystron during the pulse. The voltage from the capacitor is generally higher than that applied to the klystron, whereupon, if this voltage droops during the pulse, the difference, between the power supply voltage (or charger) and the constant voltage at the klystron, will appear as a varying voltage drop across the switch tube. The switch tube, controlled by the pulser, thus provides electrical isolation between the power supply and the klystron during the off mode, and a tightly regulated current and voltage pulse to the klystron during the on mode.

Having thus described a high power current regulating switch tube, it should be apparent to those skilled in the art that certain advantages of the within system have been achieved. It should also be appreciated that various modifications, adaptations, and alternative embodiments thereof may be made within the scope and spirit of the present invention. For example, the second embodiment could provide more than one intermediate high voltage step to split the high voltage gap into multiple lower voltage regions. The invention is further defined by the following claims.

What is claimed is:

1. A high-power switching apparatus, comprising:

a cathode having an emitting surface for emitting a hollow electron beam therefrom;

an anode cavity spaced from said cathode, said cavity having an annular opening smaller in dimension than a corresponding internal dimension that defines said cavity to provide a Faraday cage collector of said hollow electron beam;

a control electrode disposed between said cathode and said anode cavity in a non-intercepting position relative to said hollow electron beam, said control electrode further comprising a first electrode element disposed outside of said hollow electron beam and a second electrode element disposed inside of said hollow electron beam; and an intermediate high voltage electrode disposed between said control electrode and said anode cavity in a non-intercepting position relative to said hollow electron beam, said intermediate high voltage electrode further comprising a first intermediate high voltage electrode element disposed outside of said hollow electron beam and a second intermediate high voltage electrode element disposed inside of said hollow electron beam.

2. The high-power switching apparatus of claim 1 wherein said first and second electrode elements provide a controlling electric field region therebetween for modulation of said hollow electron beam.

3. The high-power switching apparatus of claim 1 wherein said first and second intermediate high voltage electrode elements provide a controlling electric field region therebetween for high voltage standoff and channeling of said hollow electron beam.

4. The high-power switching apparatus of claim 1, further comprising inner and outer arc suppressing electrodes disposed between said control electrode and said intermediate high voltage electrode, said arc suppressing electrodes being approximately at a potential of said cathode.

5. The high-power switching apparatus of claim 1, further comprising means for applying a positive voltage to said anode in order to cause said hollow electron beam from said emitting surface of said cathode to flow to said anode.

6. The high-power switching apparatus of claim 1, wherein said emitting surface of said cathode has an annular shape.

7. The high-power switching apparatus of claim 1, further comprising means for providing a modulating voltage, positive with respect to a potential of said cathode, to said control electrode.

8. The high-power switching apparatus of claim 1, further comprising means for applying a positive voltage, positive with respect to a potential of said cathode, to said intermediate high voltage electrode.

9. The high-power switching apparatus of claim 1, further comprising an ion pump disposed at one end of said high-power switching apparatus, said ion pump providing a vacuum inside said switching apparatus.

10. The high-power switching apparatus of claim 1, further comprising a coolant system consisting of at least one inlet and outlet pipe, said coolant system providing heat transfer from inside said switching apparatus.

11. A high-power switching apparatus, comprising:

a cathode having an electron emitting surface;

an anode cavity spaced from said cathode and having a voltage potential applied thereto in order to receive a hollow electron beam from said emitting surface of said cathode without a confining magnetic field to guide said hollow electron beam, said cavity having an internal dimension that provides a Faraday cage collector of said hollow electron beam;

means for modulating said hollow electron beam to switch rapidly between a high current conductive state and a zero current non-conductive state, said modulating means being disposed between said cathode and said anode cavity in a non-intercepting position relative to said hollow electron beam; and means for partitioning a voltage potential defined between said modulating means and said anode, said partitioning means being disposed between said modulating means and said anode cavity in a non-intercepting position relative to said hollow electron beam.

12. The high-power switching apparatus of claim 11, wherein said emitting surface of said cathode has an annular shape.

13. The high-power switching apparatus of claim 11, further comprising means for suppressing arc current from flowing through said modulating means, said suppressing means being disposed between said modulating means and said partitioning means.

14. The high-power switching apparatus of claim 11, further comprising means for evacuating said high-power switching apparatus.

15. The high-power switching apparatus of claim 11, further comprising means for cooling said high-power switching apparatus.

16. The high-power switching apparatus of claim 13, further comprising means for reducing spurious RF oscillation modes, said reducing means being disposed within a central area defined by said suppressing means in a non-intercepting position relative to said hollow electron beam.

17. The high-power switching apparatus of claim 16, wherein said reducing means further comprises a plate dividing said central area.

18. The high-power switching apparatus of claim 16, wherein said reducing means further comprises at least one absorber button disposed in said central area and adapted to absorb undesired RF power.

19. A high-power switching apparatus, comprising:

a cathode having an electron emitting surface;

an anode cavity spaced from said cathode having a voltage potential applied thereto in order to receive a hollow electron beam from said emitting surface of said cathode, said cavity having an internal dimension that provides a Faraday cage collector of said hollow electron beam;

means for modulating said hollow electron beam to switch rapidly between a high current conductive state and a zero current non-conductive state, said modulating means being disposed between said cathode and said anode cavity in a non-intercepting position relative to said hollow electron beam wherein said modulating means further comprises a first electrode element disposed outside of said hollow electron beam and a second electrode element disposed inside of said hollow electron beam; and means for partitioning said voltage potential defined between said cathode and said anode, said partitioning means being disposed between said modulating means and said anode cavity in a non-intercepting position relative to said hollow electron beam wherein said partitioning means further comprises at least one intermediate high voltage electrode element disposed outside of said hollow electron beam and at least one intermediate high voltage electrode element disposed inside of said hollow electron beam.

20. The high-power switching apparatus of claim 19, wherein said first and second electrode elements define a controlling electric field for modulation of said hollow electron beam.

21. The high-power switching apparatus of claim 19, wherein said intermediate high voltage electrode elements define a controlling electric field for high voltage standoff and channeling of said hollow electron beam.

22. The high-power switching apparatus of claim 19, wherein said emitting surface of said cathode has an annular shape.

23. The high-power switching apparatus of claim 19, further comprising means for changing a voltage applied to said modulating means to change between said conductive and non-conductive states.

24. A high-power switching apparatus, comprising:

a cathode having an electron emitting surface;

an anode cavity spaced from said cathode and having a voltage potential applied thereto in order to receive a hollow electron beam from said emitting surface of said cathode, said cavity having an internal dimension that provides a Faraday cage collector of said hollow electron beam;

means for modulating said hollow electron beam to switch rapidly between a high current conductive state and a zero current non-conductive state, said modulating means being disposed between said cathode and said anode cavity in a non-intercepting position relative to said hollow electron beam;

inner and outer arc suppressing electrodes disposed between said modulating means and said anode cavity, said arc suppressing electrodes being approximately at a potential of said cathode; and means for partitioning said voltage potential defined between said cathode and said anode, said partitioning means being disposed between said inner and outer arc suppressing electrodes and said anode cavity in a non-intercepting position relative to said hollow electron beam.

25. The high-power switching apparatus of claim 24, wherein said emitting surface of said cathode has an annular shape.

26. The high-power switching apparatus of claim 24, wherein said high-power switching apparatus is mounted on ceramic insulators.

* * * * *